United States Patent [19]

Ishii et al.

[11] Patent Number: 4,475,456

[45] Date of Patent: Oct. 9, 1984

[54] OFFSET PERFECTING PRESS

[75] Inventors: Koji Ishii; Takahiko Shinmoto; Kenso Maehara; Yoshinori Honkawa, all of Hiroshima, Japan

[73] Assignee: Ryobi Ltd., Hiroshima, Japan

[21] Appl. No.: 497,991

[22] Filed: May 25, 1983

[30] Foreign Application Priority Data

May 27, 1982 [JP] Japan ..... 57-91066

[51] Int. Cl.[3] ..... B41F 7/12; B41F 13/20; B41F 13/28; B41F 21/08

[52] U.S. Cl. ..... 101/144; 101/231; 101/233; 101/425; 101/352

[58] Field of Search ..... 101/136, 352, 137, 231, 101/138, 139, 140, 142, 143, 144, 145, 179, 177, 229, 217, 218, 425, 182, 183, 184, 185, 247, 232, 233

[56] References Cited

U.S. PATENT DOCUMENTS 3,056,346 10/1962 Gammeter et al. ..... 101/144
3,490,367 1/1970 Kaneko et al. ..... 101/144
3,858,508 1/1975 Kaneko ..... 101/142 X
3,956,985 5/1976 Ishii ..... 101/142
4,084,508 4/1978 Kaneko et al. ..... 101/144 X
4,412,488 11/1983 Ishii ..... 101/144 X

*Primary Examiner*—J. Reed Fisher
*Attorney, Agent, or Firm*—Sughrue, Mion, Zinn, Macpeak, and Seas

[57] ABSTRACT

A printing apparatus of the type capable of printing on both sides of a paper supplied thereto is improved by enabling simple operation through the use of a single operating lever. Adjustment devices allow simple vertical and transversely adjustment of the plate cylinders with respect to the paper position. After printing is effected, the operating lever is shifted stepwise from the printing position to a starting position through intermediate positions wherein blanket cleaning and plate ejection functions are effected. Changeover between single and two-sided printing is easily effected by a simple switch operation.

11 Claims, 24 Drawing Figures

OFFSET PERFECTING PRESS

BACKGROUND OF THE INVENTION

This invention relates to an offset perfecting press comprising a first rubber cylinder, a first plate cylinder, a second rubber cylinder serving also as an impression cylinder, and a second plate cylinder.

This perfecting press has a smaller number of cylinders, and is simpler and more compact in construction than any conventional combination of two presses each having a rubber cylinder, a plate cylinder and an impression cylinder.

Perfecting presses of this type, however, have common problems which are due to the simultaneous printing on both sides of paper disposed between the first and second rubber cylinders. The adjustment of images on both sides of the paper is very troublesome and difficult. Many complications and difficulties are involved in the movement of the cylinders toward and away from one another, plate feeding and discharge, moistening, inking, blanket cleaning and other operations, and in the selective operation for printing on one or both sides of the paper.

SUMMARY OF THE INVENTION

In view of these problems, it is an object of this invention to provide a perfecting press which enables the stable flow of paper to be printed and the printed paper, facilitates the adjustment of images on both sides of the paper, and selective operation for printing on one or both sides of the paper, and which is easy to operate using a single lever for excellent printing on either one or both sides of the paper.

BRIEF DESCRIPTION OF THE DRAWINGS

A perfecting press embodying this invention is shown in the accompanying drawings, in which.

DETAILED DESCRIPTION OF THE PREFERRED EMBODIMENTS

Figure 1:
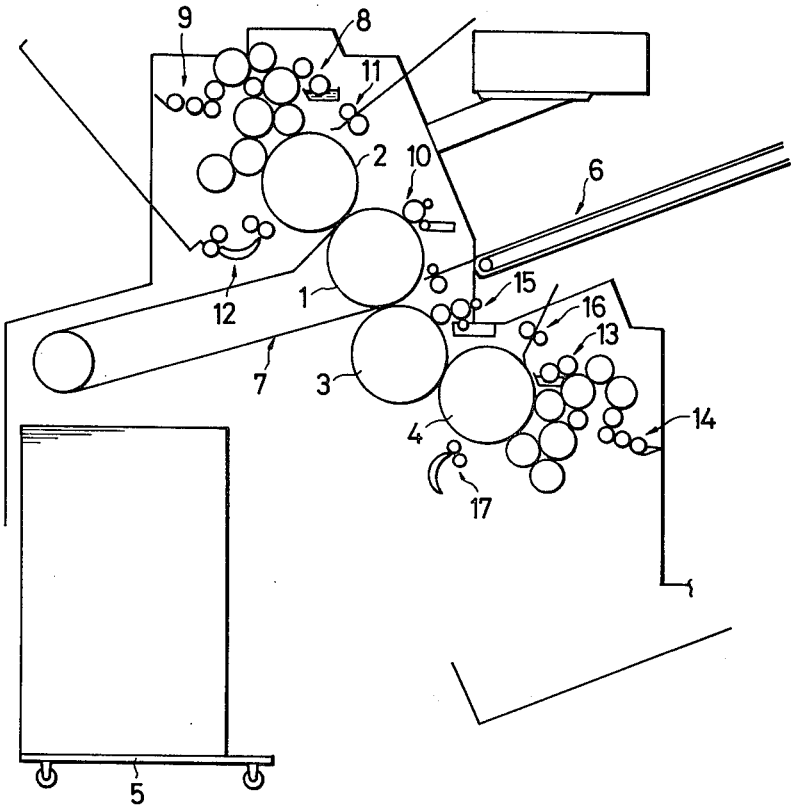
FIG. 1 is an outline of the press.
Figure 3:
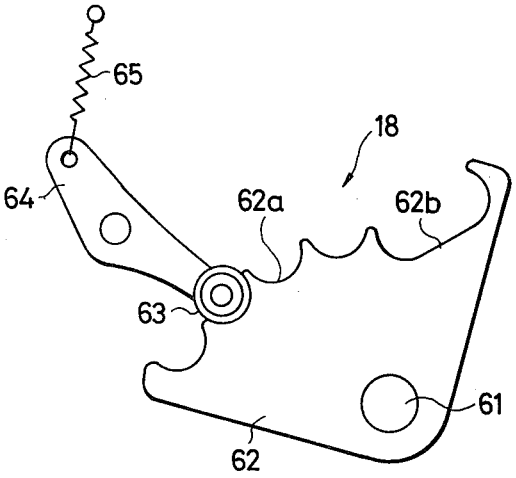
FIG. 3 is a front elevational view of the operating lever positioning mechanism.
Figure 4:
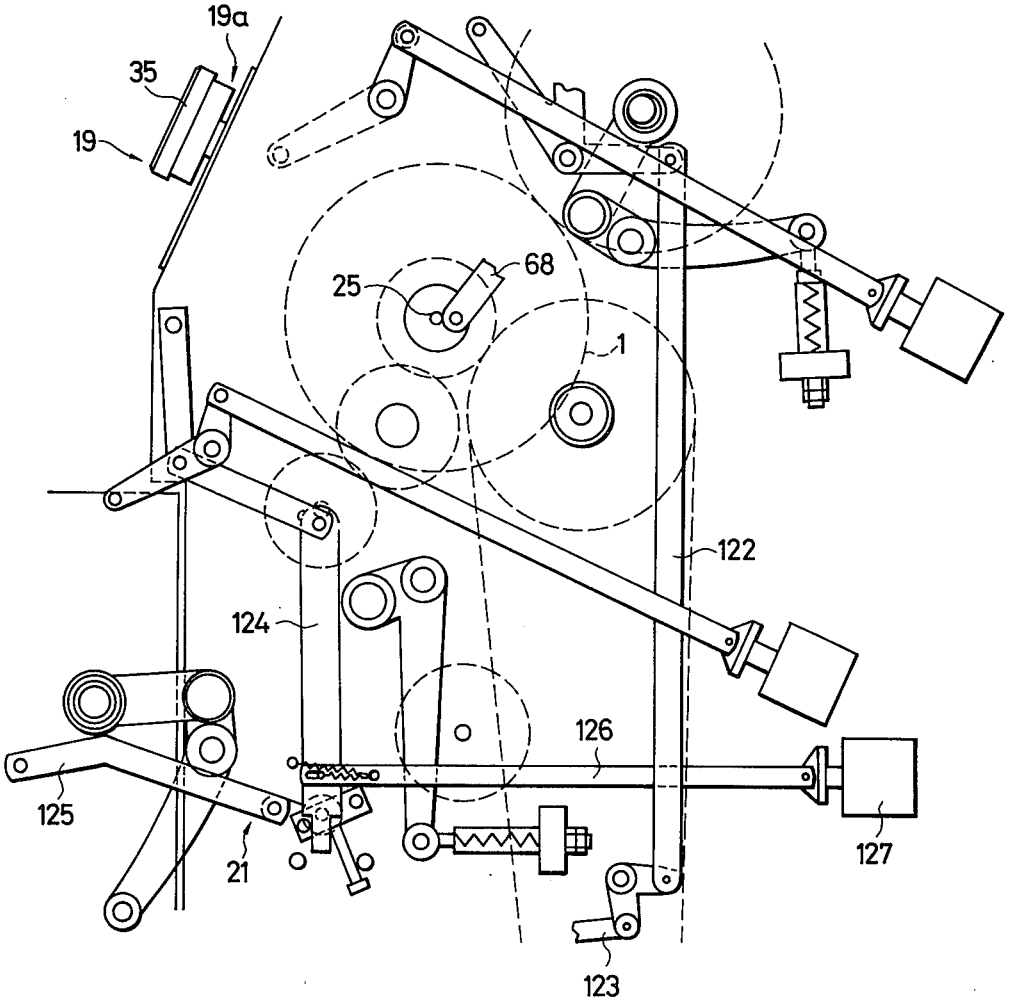
FIG. 4 is a side elevational view of the first image adjusting device and a part of the second printing control device.
Figure 8:
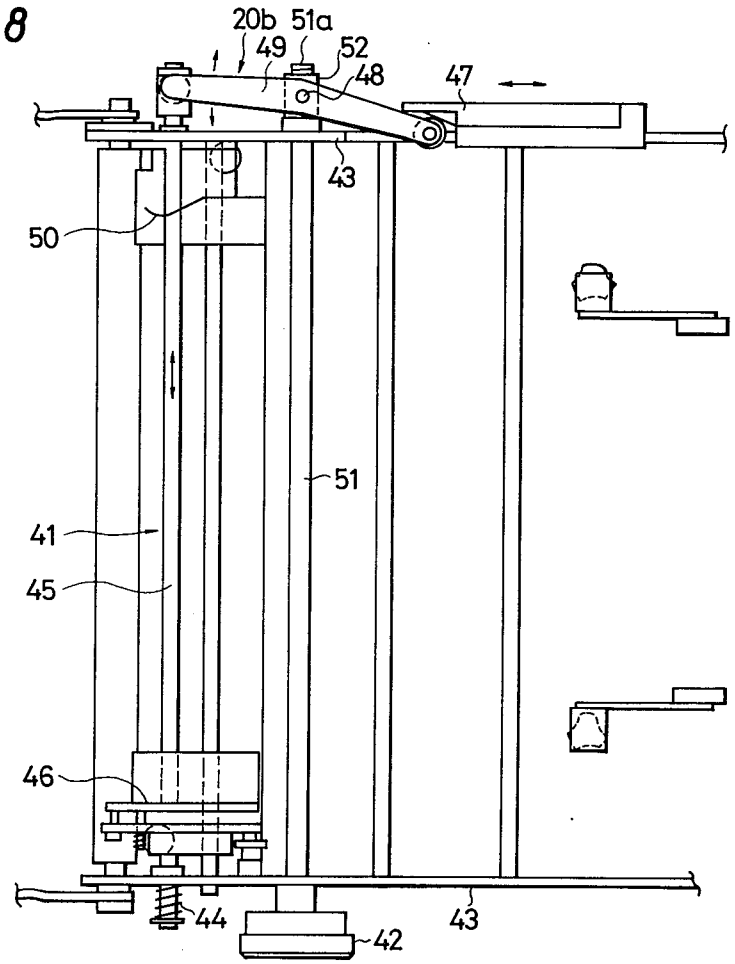
FIG. 8 is a top plan view of the transverse image adjusting mechanism in the second image adjusting device.
Figure 5:
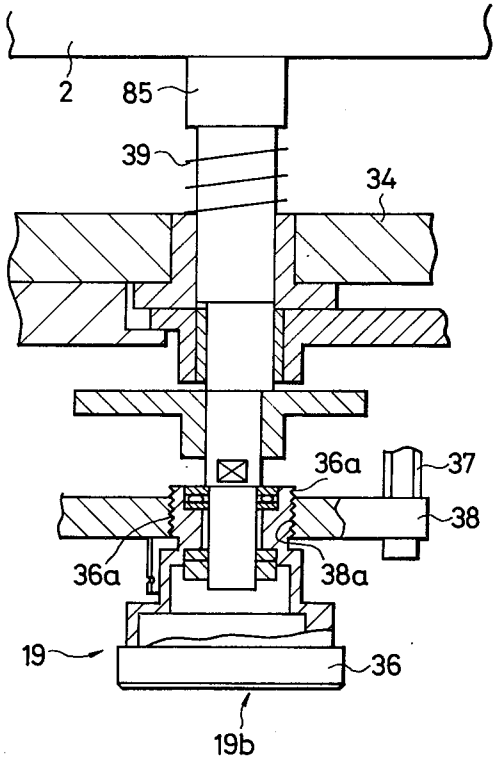
FIG. 5 is a top plan view, partly in longitudinal section, of the transverse image adjusting mechanism in the first image adjusting device.
Figure 6:
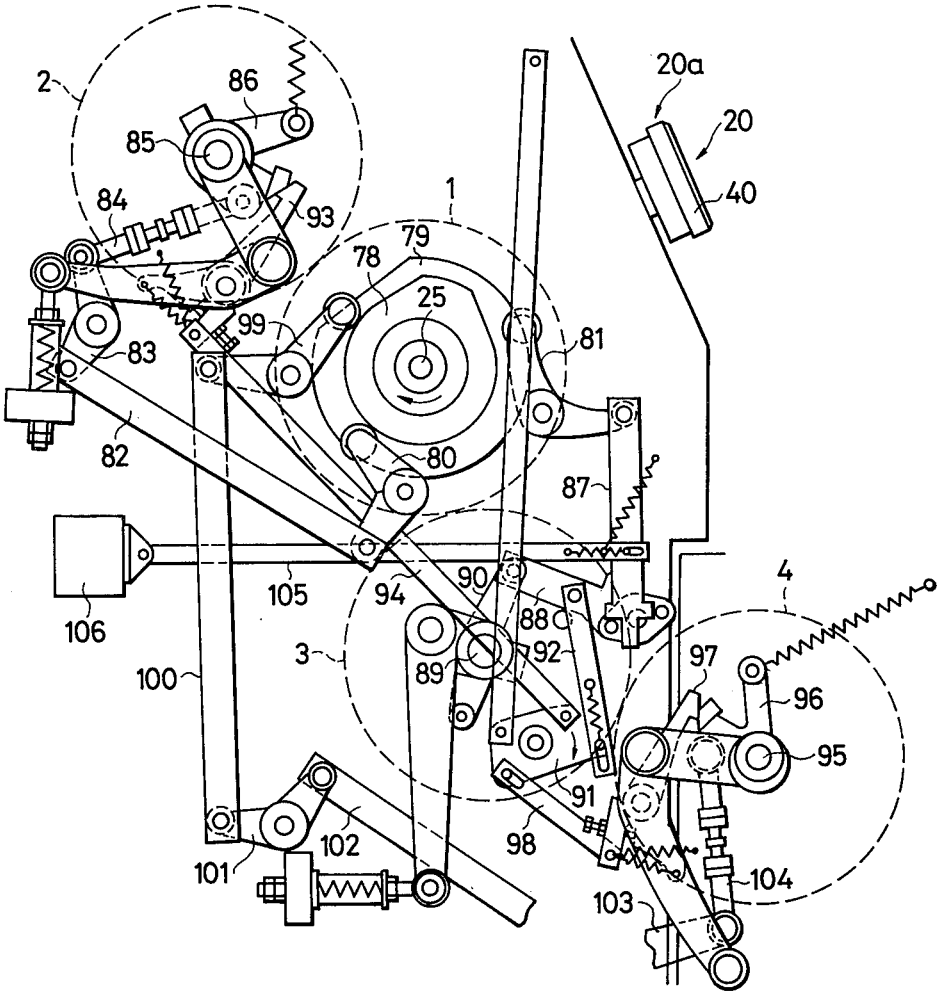
FIG. 6 is a front elevational view of the mechanism for moving the cylinders toward and away from one another.
Figure 7A:
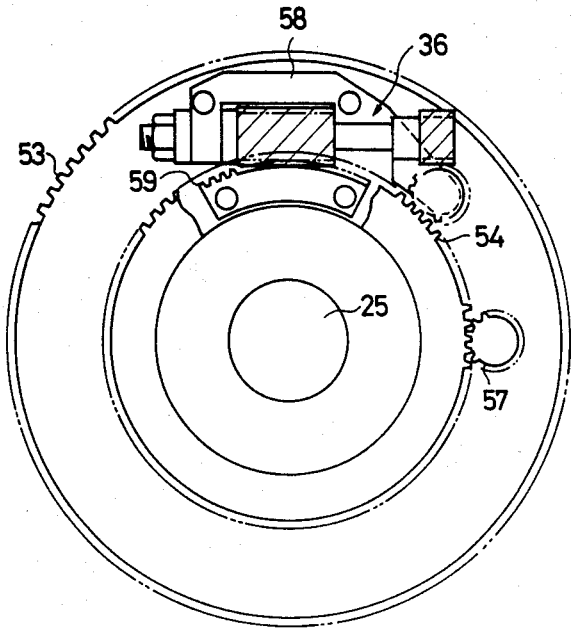
FIGS. 7A and 7B are front and side elevational views, respectively, of the vertical image adjusting mechanisms in the first and second image adjusting devices.
Figure 7B:
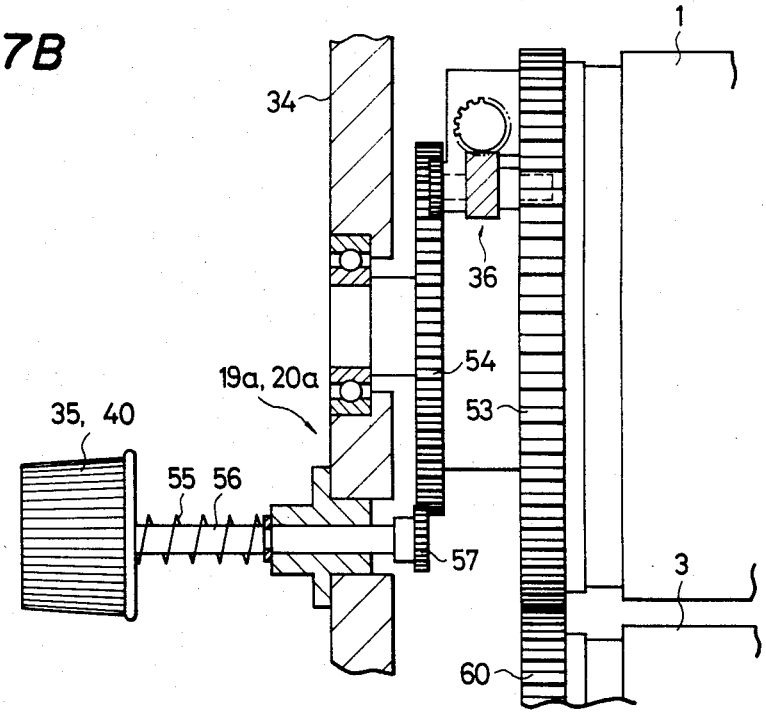
Figure 9:
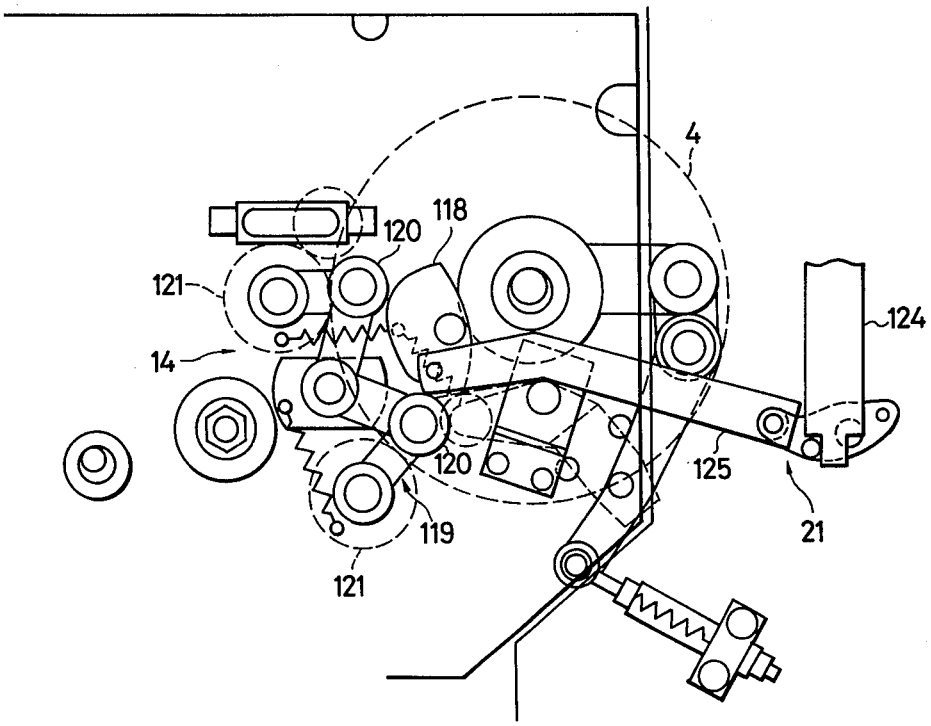
FIG. 9 is a side elevational view of the second inking device.

The invention will now be described in detail by way of example with reference to the accompanying drawings. Referring to FIG. 1, a press embodying this invention includes a first rubber cylinder 1 adapted for rotation at a fixed position, a first plate cylinder 2 and a second rubber cylinder 3 which are each supported on an eccentric shaft and are movable into contact with, and away from the first rubber cylinder 1, the second rubber cylinder 3 serving also as an impression cylinder, and a second plate cylinder 4 supported on an eccentric shaft and movable into contact with, and away from the second rubber cylinder 3. The device also includes a paper feeder for feeding paper between the first and second rubber cylinders 1 and 3, a paper discharger 7 for conveying the printed paper to a discharge table 5, a first moistening device 8, a first inking device 9, a first blanket cleaner 10, a first plate feeder 11, a first plate discharger 12, a second moistening device 13, a second inking device 14, a second blanket cleaner 15, a second plate feeder 16 and a second plate discharger 17. It further includes an operating lever device 18 as shown in FIG. 3, a first image adjusting device 19 as shown in FIGS. 4 and 5, a second image adjusting device 20 as shown in FIGS. 6 to 8, and a second printing control device 21 as shown in FIGS. 4 and 9.

Figure 10:
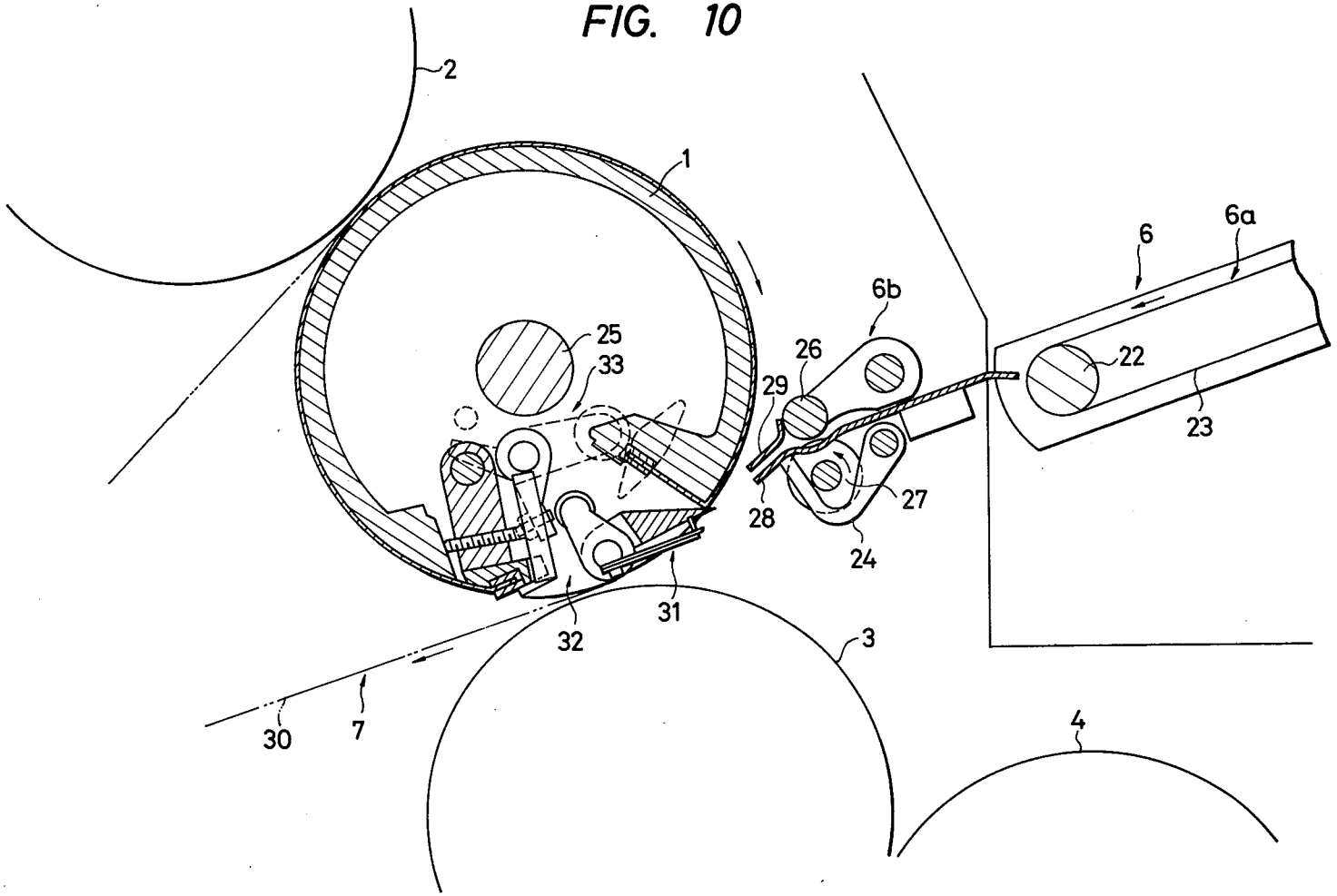
FIG. 10 is a side elevational view, partly in section, of the principal parts of the paper feeder and the paper discharger.

The paper feeder 6 comprises a feeding portion 6*a* and a paper insertion portion 6*b* as shown in FIG. 10.

The feeding portion 6*a* comprises a plurality of rollers 22 and a belt 23. The paper insertion portion 6*b* comprises a stop finger 24 which temporarily stops the paper, an upper roll 26 which is vertically movable by a cam secured to the shaft 25 of the first rubber cylinder, but notshown, a lower roll 27, a lower paper guide 28 and an upper paper guide 29. If the paper roll 26 is brought into contact with the lower roll 27, which is rotated, so that the paper may be held between the rolls, the paper is fed by the guides 28 and 29 along a path between the first and second rubber cylinders 1 and 3.

The paper discharger 7 includes chains 30 extending about sprockets provided at both ends of the first rubber cylinder 1, but not shown, and sprockets rotatably supported above the discharge table, and a gripper 31 extending between the chains 30. As the first rubber cylinder 1 is rotated, the chains 30 are driven and the gripper 31 is engaged in the opening 32 of the first rubber cylinder 1. The gripper 31 is opened and closed by an opening and closing mechanism 33 in the opening 32 to grip and move the paper delivered by the paper insertion portion 6*b*. The ink supplied to the first and second plate cylinders 2 and 4 by the first and second inking devices 9 and 14 is transferred to the first and second rubber cylinders 1 and 3, whereby the paper is printed on both sides. The printed paper is conveyed to a point above the discharge table 5, and discharged.

The first image adjusting device 19 (for the front side of the paper) comprises a vertical adjusting mechanism 19*a* and a horizontal adjusting mechanism 19*b* as shown in FIGS. 4 and 5. The vertical adjusting mechanism 19*a* comprises an operating knob 35 supported rotatably on a press frame 34, the rotation of which is transmitted to the first plate cylinder 2 through a gear transmission. The horizontal adjusting mechanism 19*b* is shown in FIG. 5, and comprises an operating knob 36 attached rotatably, but axially immovably, to the outer end of the shaft 85 for the first plate cylinder extending between the press frames 34. The operating knob 36 has an externally threaded base end portion 36*a*. A frame 38 is secured to the press frame 34 by a stud bolt 37 or the like, and has a threaded hole 38*a*. The threaded base end portion 36*a* is engaged axially movable in the threaded hole 38*a* so that if the knob 36 is turned, the shaft 85 for the first plate cylinder may be axially moved to effect horizontal adjustment of the image.

A compression spring 39 is disposed between the press frame 34 and the shaft 85 of the first plate cylinder to urge the shaft 85 in one direction. The resilient force of the spring 39 and the uni-directional thrust load applied by the knob 36 to the first plate cylinder 2 against the force of the spring absorb any loosening between the threaded portions 36*a* and 38*a*.

The second image adjusting device 20 (for the reverse side of the paper) comprises a vertical adjusting mechanism 20*a* and a horizontal adjusting mechanism 20*b*.

The vertical adjusting mechanism 20*a* comprises an operating knob 40 rotatably supported on the press frame 34 as shown in FIG. 6. The rotation of the knob 40 is transmitted through a gear transmission to the second rubber cylinder 3 and the second plate cylinder 4, as in the case of the first image adjusting device 19. The horizontal adjusting mechanism 20*b* comprises an operating knob 42 which is rotatable to transversely move a paper aligning mechanism 41 on a feeder board, as shown in FIG. 8, whereby the horizontal adjustment of the paper position is effected to accomplish the horizontal adjustment of the image.

The paper aligning mechanism 41 comprises a slide shaft 45 slidably supported between the frames 43 of the feeder board and urged by a spring 44 toward its original position, as shown in FIG. 8. A paper support 46 is secured to one end of the slide shaft 45 so that one side edge of the paper may abut the paper support 46. The other end of the slide shaft 45 is rotatably connected to an arm 49 which is transversely rotatable about a pin 48 by means of a cam 47 which is longitudinally reciprocable when the press is driven. A leaf spring 50 is secured to the feeder board, and faces the paper support 46. The paper support 46 is transversely reciprocable by the slide shaft 45 toward and away from the spring 50 to bring the paper into a transversely aligned position.

The operating knob 42 is secured to one end of an operating shaft 51 which is supported rotatably, but axially immovably between the frames 43. The other end of the shaft 51 is externally threaded at 51*a*. The arm 49 is rotatably supported on a block 52 which is threadedly connected about the threaded end 51*a*. If the shaft 51 is rotated by the knob 42, the block 52 is moved transversely with the arm 49 to move the paper support 46 transversely, whereby the transverse position of the paper is adjusted as required to effect the transverse adjustment of the image.

The vertical adjusting mechanisms 19*a* and 20*a* of the first and second image adjusting mechanisms 19 and 20, respectively, are more specifically constructed as will hereinafter be described. As shown by way of example in FIGS. 7A and 7B, a gear 53 and an adjusting gear 54 are rotatably fitted on the first rubber cylinder 1. An operating knob shaft 56 is rotatably and axially slidably supported on the frame 34, and urged outwardly by a spring 55. A gear 57 is attached to the shaft 56, and engageable with the adjusting gear 54. The gear transmission 36 is rotatably supported on the gear 53 by a bracket 58. The rotation of the shaft 56 is transmitted by the gear transmission 36 to worm wheel 59 secured to the first rubber cylinder 1.

The gear 53 is loosely fitted on each end of the first rubber cylinder 1. One of the gears 53 is engaged with a gear (not shown) secured to the first plate cylinder 2. The other gear 53 is engaged with a gear 60 secured to the second rubber cylinder 3 as shown, and the gear 60 is engaged with a gear (shown) secured to the second plate cylinder 4. Thus, the mechanisms are provided on the drive and driven sides, respectively, of the press.

The drawings show the vertical adjusting mechanism of the second image adjusting device 20 which is provided on the drive side. If the operating knob shaft 56 is forced inwardly, the gear 57 is brought into engagement with the adjusting gear 54, and if the operating knob 40 is turned, the gear 54 is rotated. The reaction force of the worm wheel 59 secured to the first rubber cylinder 1 causes the rotation of the gear transmission 36 and the gear 53 whereby the second rubber cylinder 3 and the second plate cylinder 4 are rotated.

As the second rubber cylinder 3 and the second plate cylinder 4 are rotated relative to the first rubber cylinder 1, there occurs a change in the circumferential positional relationship between the first and second rubber cylinders 1 and 3. This effects the vertical adjustment of the printing paper fed between the rubber cylinders 1 and 3.

The vertical adjusting mechanism 20*a* of the first image adjusting device 19 is operated in a similar way. If the operating knob 35 is forced inwardly and turned, the gear transmission 36 and the gear 53 are rotated to rotate the first plate cylinder 2. The rotational position of the first plate cylinder 2 relative to the first rubber cylinder 1 is altered to effect the vertical adjustment of the image posi- tion.

Figure 2:
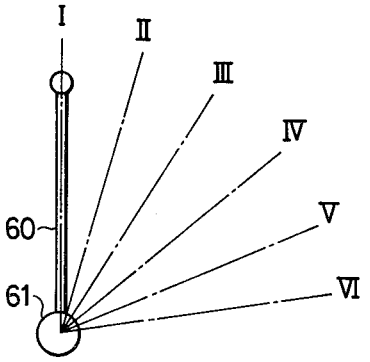
FIG. 2 illustrates the operation of the operating lever.

The operating lever device 18 includes an operating lever 60 which is secured to an operating shaft 61, and is adapted to effect six changeover steps in operation, as shown in FIGS. 2 and 3. The changeover is effected for plate feeding, printing, plate discharge and blanket cleaning.

The positioning of the operating lever 60 for the various steps of operation is achieved by a set cam 62 having five engaging portions 62*a* and a cam portion 62*b*, and which is secured to the operating shaft 61, as shown in FIG. 3. An engaging roller 63 is rotatably carried on one end of an arm 64 supported rotatably on a frame, and is engageable with any of the engaging portions on the set cam 62 by the action of the spring 65. If the lever 60 and the operating shaft 61 are rotated, the cam 62 is rotated to bring the roller 63 into engagement with the engaging portions 62*a* one after another so that the lever 60 may be held in any particular changeover position. The cam portion 62*b* causes the lever 60 to return automatically from position VI to position V.

The various steps of the printing operation are carried out by the progressive changeover of the lever 60, and after the printing operation is over, the lever 60 returns to its initial position automatically by passing through the various steps progressively in the reverse order.

Figure 11:
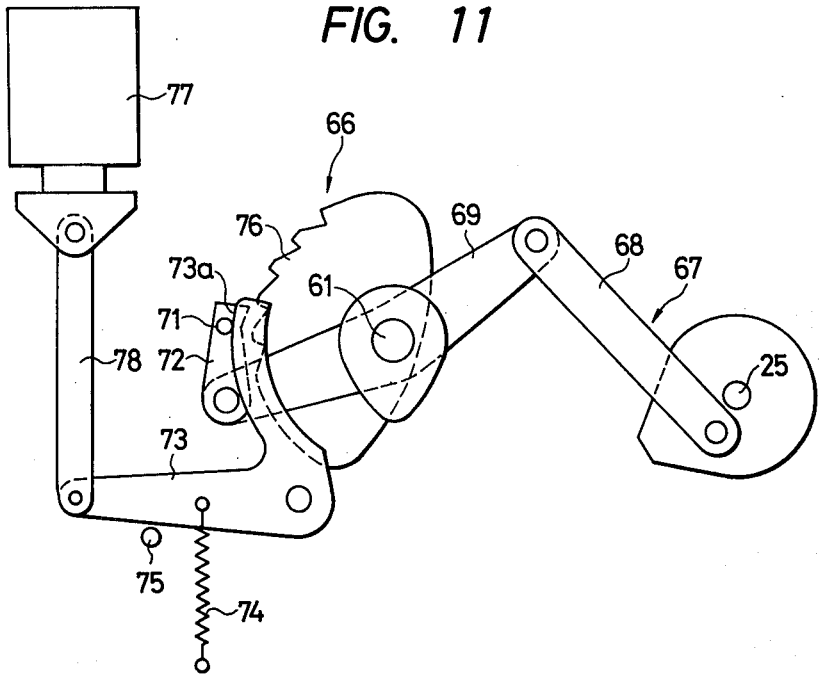
FIG. 11 is a front elevational view of the mechanism for the automatic return of the operating lever.

The automatic return mechanism 66 is shown in FIG. 11, and comprises a crank mechanism 67 attached to the shaft 25 of the first rubber cylinder, and having a link 68 and an arm 69 which is rotated thereby. A pawl 72 having a pin 71 is rotatably carried on the free end of the arm 69, and is reciprocable upon rotation of the arm 69. Prior to the completion of printing, the end 73*a* of a cam 73 is maintained in abutment on the pin 71 to hold it in a raised position. A spring 74 maintains the cam 73 in abutment with a stop 75 so that the cam 73 may hold the pin 71 in its raised position, in which the pawl is not in engagement with a ratchet 76 secured to the operating shaft 61. If a signal indicating the end of the printing operation is recieved from a counter which counts the gradually decreasing number of sheets of printing paper, a solenoid 77 is energized to move a link 78 to rotate the cam 73, whereby the pin 71 is lowered to enable the pawl 72 to engage the ratchet 76.

If the pawl 72 is engaged with the ratchet 76, the rotation of the first rubber cylinder shaft 25 causes the rotation of the ratchet 76 and the operating shaft 61 which causes the operating lever 60 to return progressively to its initial position.

A mechanism for moving the cylinders toward and away from one another is shown in FIG. 6.

A cylinder advancing cam 78 is secured to the first rubber shaft 25, and is rotatable by means of arms 80 and 81 supported rotatably on a frame, and each having one end contacting the cam 78, 79. The other end of the arm 80 is connected by a link 82, an arm 83 and an adjusting rod 84 to an arm 86 secured to the eccentric shaft 85 of the first plate cylinder 2. The other end of the arm 81 is connected by a projection 87 and a link 88 to an arm 90 secured to the eccentric shaft 89 of the second rubber cylinder 3.

An arm 91 is rotatably carried on the frame, and connected by a link 92 to the link 88. The arm 91 is connected by a link 94 to a latch 93 by which the arm 86 is releasably engaged, and by a link 98 to a latch 97 by which an arm 96 secured to the eccentric shaft 95 of the second plate cylinder is releasably engaged.

An arm 99 is rotatably carried on the frame so as to be rotatable by the cam 78. The arm 99 is connected to the arm 96 on the eccentric shaft 95 by a link 100, an arm 101, a link 102, an arm 103 and an adjusting rod 104.

The projection 87 is connected by a link 105 to a solenoid 106.

If the first rubber cylinder 1 is rotated, the cam 78 and the mechanism described above cause the eccentric rotation of the first plate cylinder 2, the second rubber cylinder 3 and the second plate cylinder 4, while the first plate cylinder 2 and the second rubber cylinder 3 are moved toward and away from the first rubber cylinder 1, and the second plate cylinder 4 toward and away from the second rubber cylinder 3. If paper is fed and detected by a photodetector (not shown), the solenoid 106 is energized to move the projection 87 to its position shown in the drawing. The arms 86 and 90 are rotated to advance the first plate cylinder 2 and the second rubber cylinder 3 into contact with the first rubber cylinder. The latch 93 engages the arm 86 to hold the cylinders 2 and 3 in their advanced positions. The arm 96 for the second plate cylinder 4 is also rotated and engaged with the latch 97 to hold the cylinder 4 in its advanced position.

If the supply of paper is discontinued, the solenoid 106 is deenergized, and the cylinders 2 to 4 are retracted.

Figure 12:
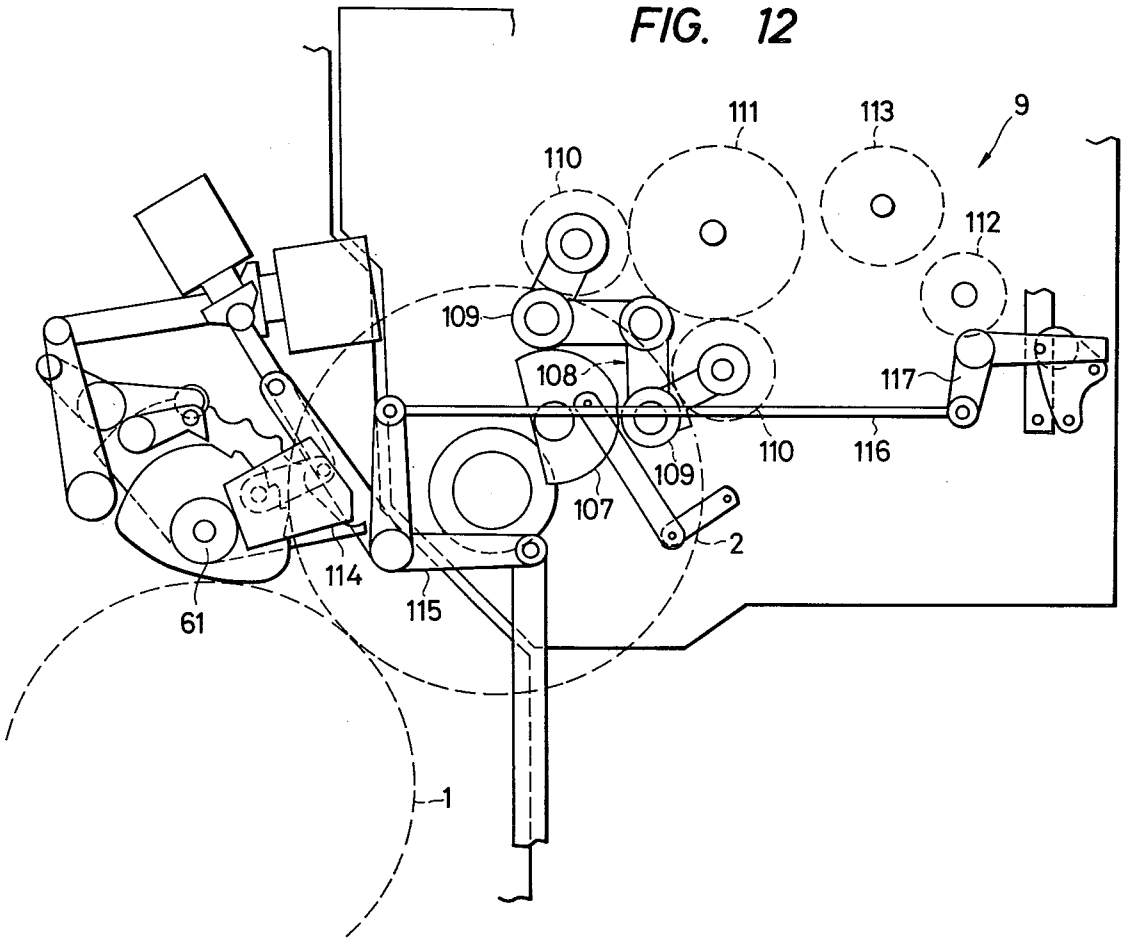
FIG. 12 is a side elevational view of the first inking device.

Referring to FIG. 12, the first inking device 9 includes a cam 107 provided rotatably on a frame, a link mechanism 108 having a pair of rollers 109 contacting the cam 107, an intermediate roller 111 disposed in contact with form rollers 110, an ink fountain roller 112, and an ink ductor roller 113 swingably disposed between the intermediate roller 111 and the ink fountain roller 112.

The cam 107 is actuated by the operating lever 60 to move the form rollers 110 into contact with the first plate cylinder 2 and away therefrom.

The ink ductor roller 113 is connected by a link 116, an arm 117, etc. to an arm 115 rotatably provided on a frame so to be swung by a cam 114 secured to the operating shaft 61. The roller 113 is swung between the ink fountain roller 112 and the ink ductor roller 113 when the operating lever 60 has been turned to a prescribed position.

The second inking device 14 is shown in FIG. 9. A cam 118 is provided rotatably on a frame, and a link mechanism 119 has a pair of rollers 120 contacting the cam 118. A pair of form rollers 121 are rotatably carried on the link mechanism 119, and are movable into contact with the second plate device described above, an intermediate roller (not shown) is disposed in contact with the form rollers 121, and an ink ductor roller is swingably disposed between the intermediate roller and an ink fountain roller (not shown). The ink ductor roller is connected by links 122 and 123, etc. to the arm 115, and is operationally associated with the first ink ductor roller 113.

The second printing control device 21 is provided for the second inking device 14.

The second printing control device 21 is shown in FIGS. 4 and 9. A swinging projection 124 is connected to the cam 118 by a link 125, and to a solenoid 127 by a link 126. If the solenoid 127 is switched on, the cam 118 is rotated to move the form rollers 121 into contact with the second plate cylinder 4.

The second inking device 14 is independently operable to selectively enable printing on both sides if the form rollers 121 are brought into contact with the second plate cylinder 4, or printing on one side, i.e., the first or front side, if the rollers 121 are separated from the second plate cylinder.

Figure 13:
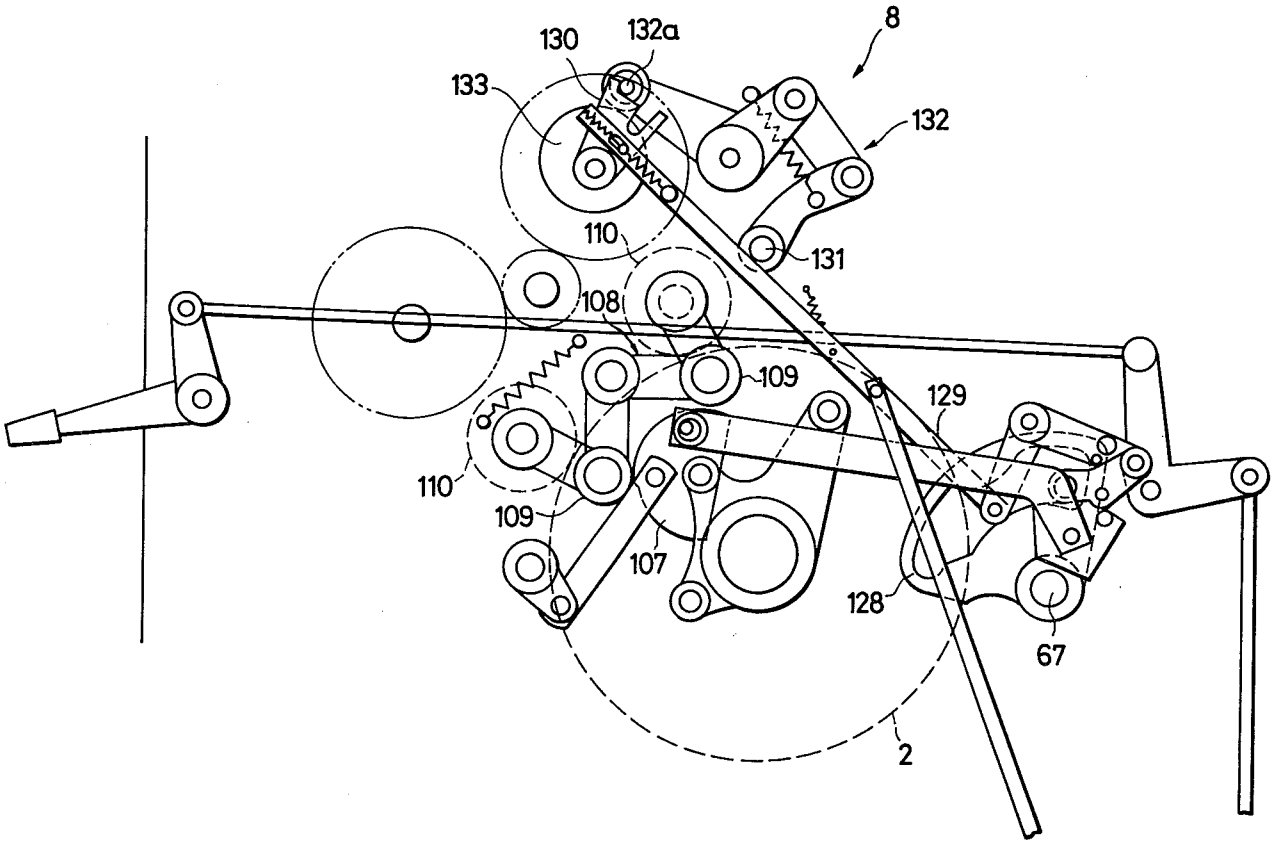
FIG. 13 is a side elevational view of the first moistening device.
Figure 14:
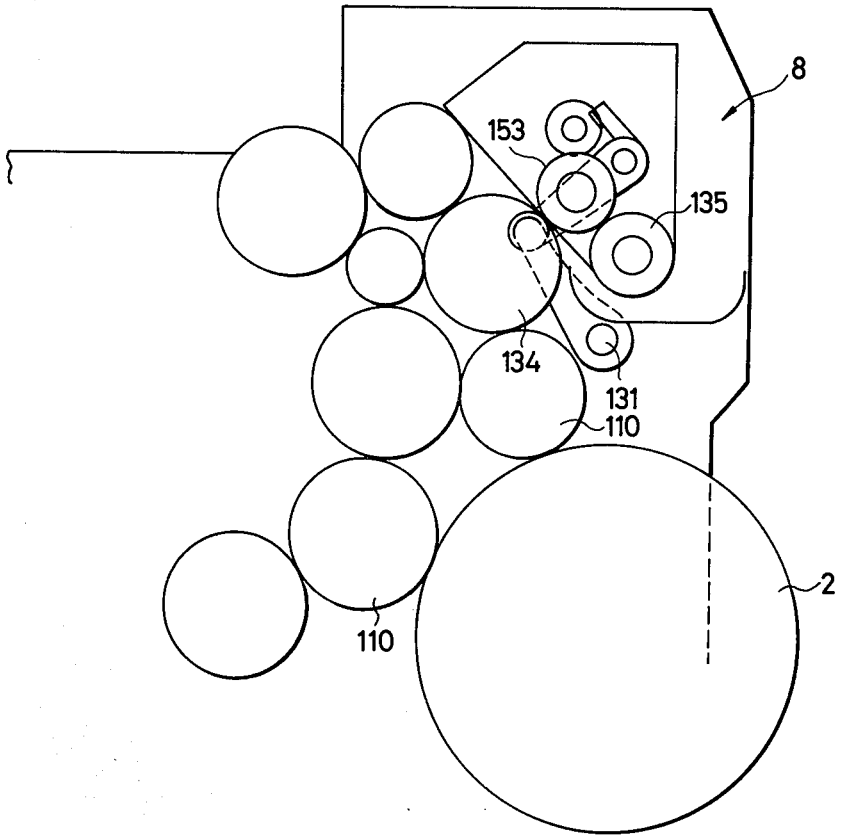
FIG. 14 is a side elevational view, partly in section, of the first moistening device.

The first moistening device 8 is shown in FIGS. 13 and 14.

A latch 130 is connected by a link 129 to a cam 128 secured to the operating shaft 61, and is actuated if the operating lever 60 is turned to a prescribed position. A water ductor roller 153 is rotatably supported on a driven shaft 131 by a link mechanism 132, and is swingable by means of a cam 133 between an intermediate roller 134 and a water fountain roller 135. If the operating lever 60 is turned to the prescribed position, the latch 130 engages a pin 132*a* on the link mechanism 132 to stop the swinging motion of the water ductor roller.

Figure 15:
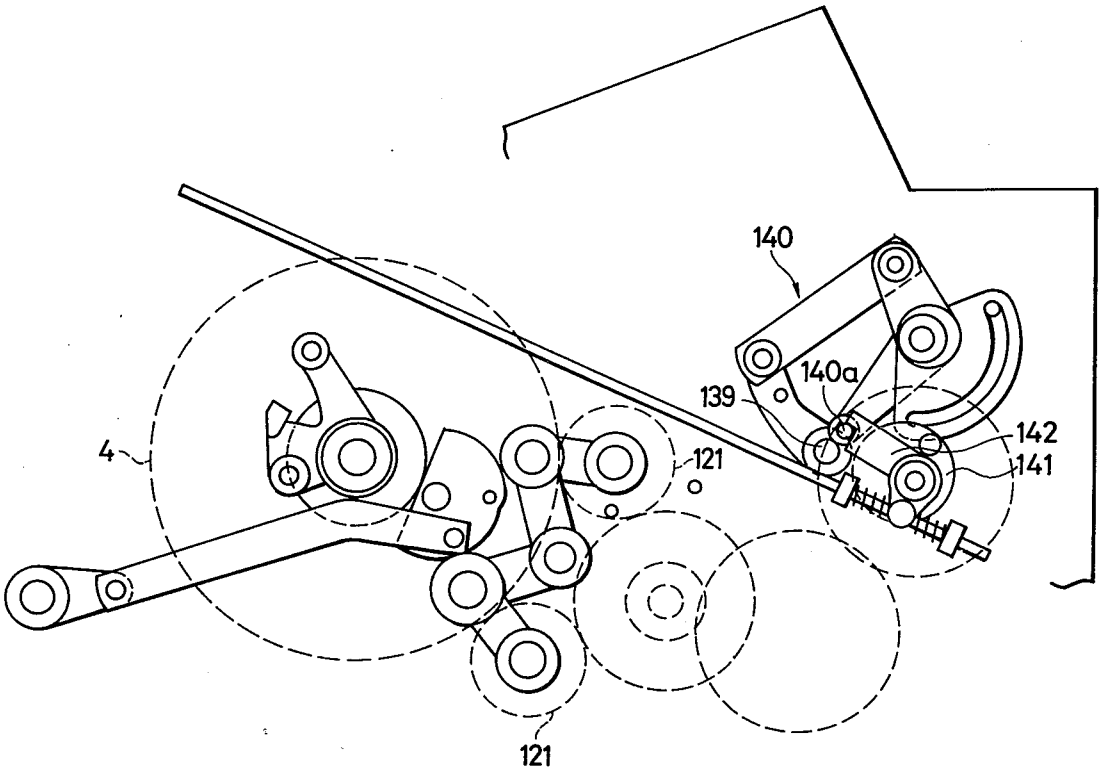
FIG. 15 is a side elevational view of the second moistening device.
Figure 16:
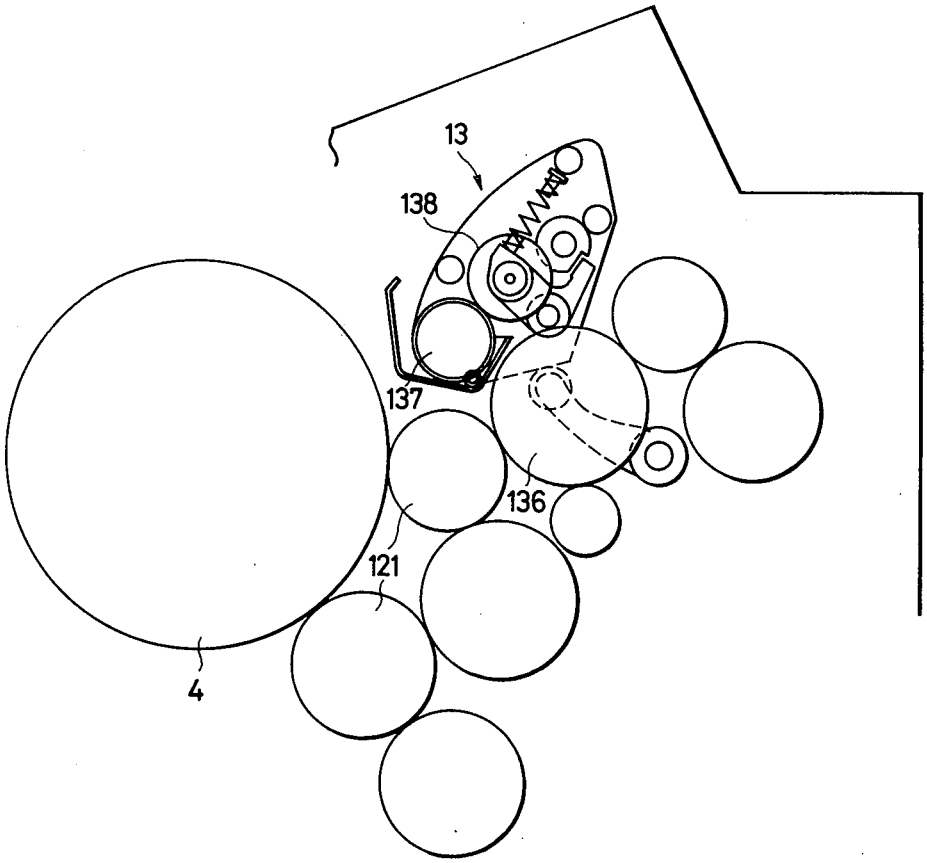
FIG. 16 is a side elevational view, partly in section, of the second moistening device.

The second moistening device 13 is shown in FIGS. 15 and 16.

The second moistening device 13 includes a water ductor roller 138 swingably disposed between an intermediate roller 136 rotatably supported in contact with the form roller 121, and a water fountain roller 137. The water ductor roller 138 is rotatably supported by a link mechanism 140, swingable by a cam 141 and rotatable by a drive shaft 139.

A latch 142 is rotatably supported with the cam 141, and is connected by a link 143 to the link 129 in the first moistening device 3. Thus, the latch 142 is operationally associated with the first moistening device 3, and is adapted to engage a pin 140*a* on the link mechanism 140 to stop the swinging motion of the water ductor roller 138.

Figure 17:
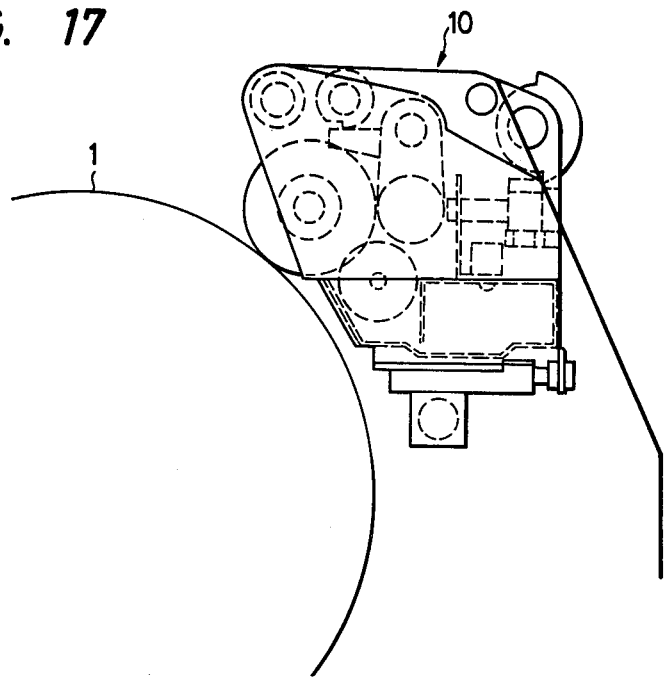
FIG. 17 is a side elevational view of the first blanket cleaning device.
Figure 18:
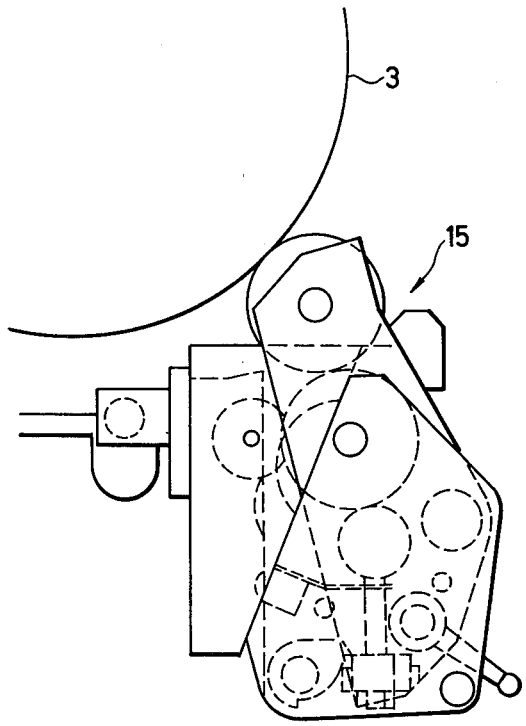
FIG. 18 is a side elevational view of the second blanket cleaning device.
Figure 19:
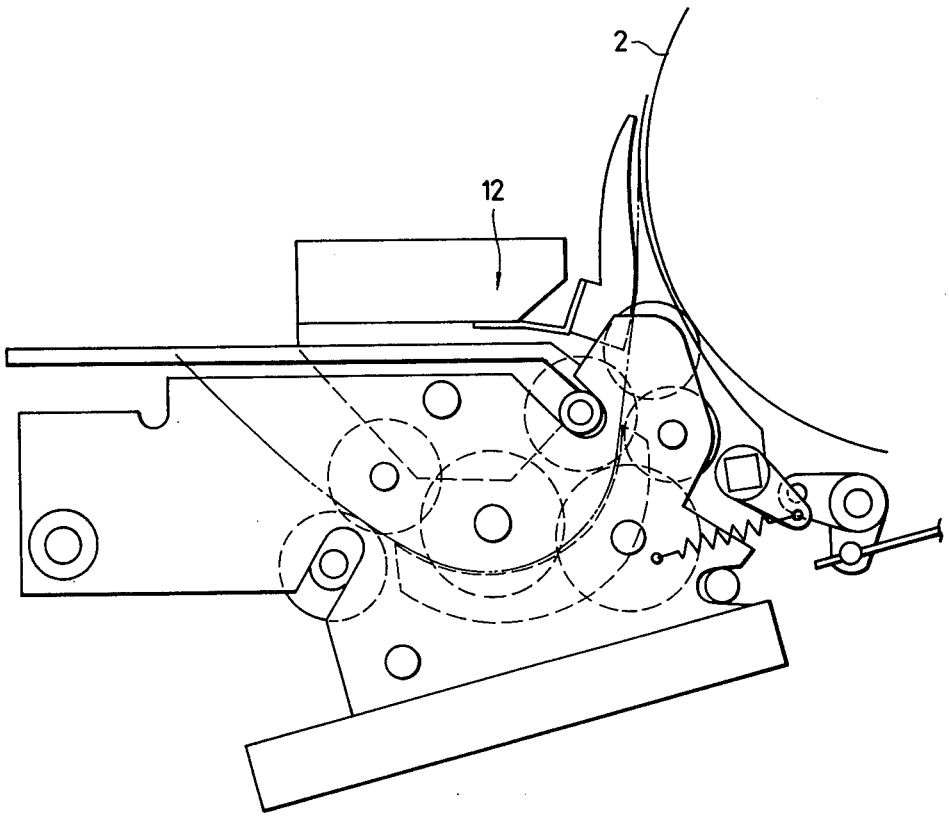
FIG. 19 is a side elevational view of the first plate ejection device.
Figure 20:
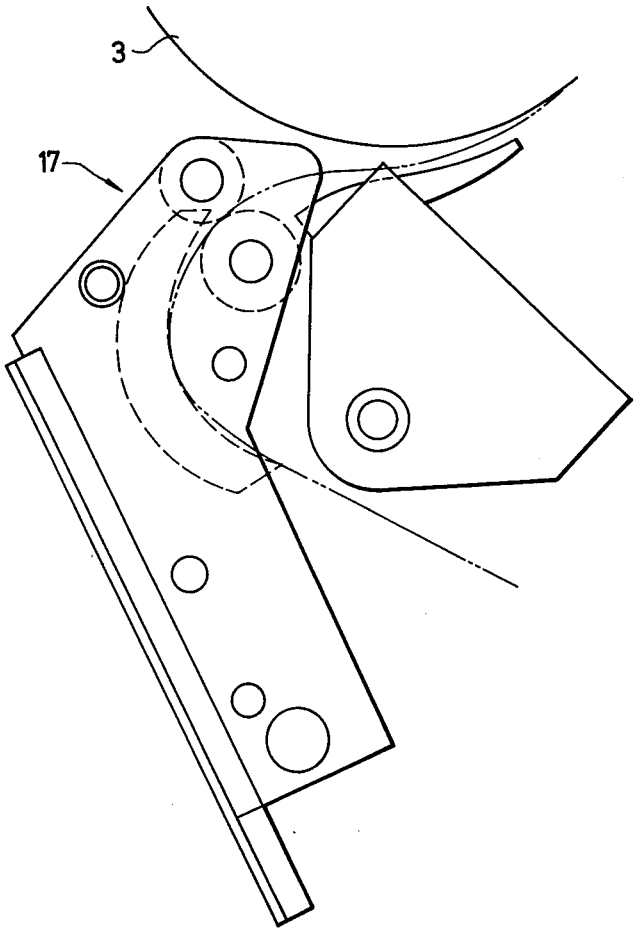
FIG. 20 is a side elevational view of the second plate ejection device.
Figure 21:
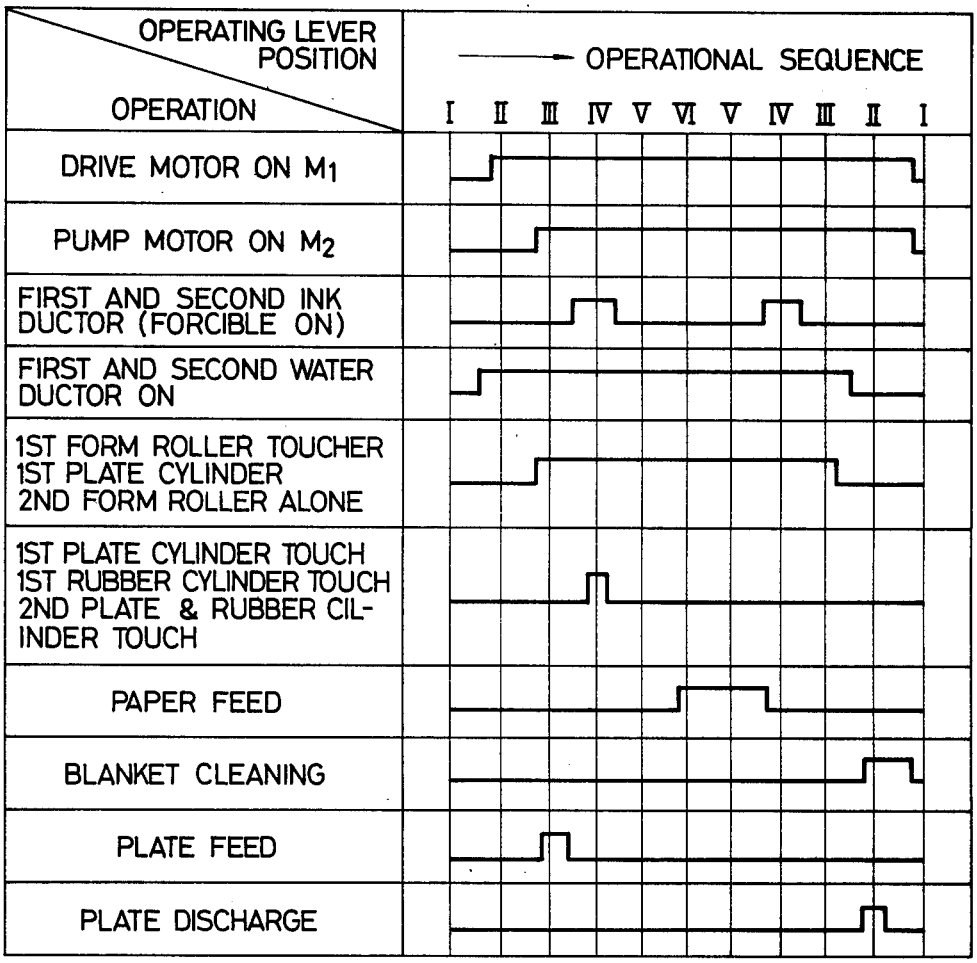
FIG. 21 is a diagram showing the relation between the position of the operating lever and the operation of the various devices.

The first blanket cleaning device 10 is shown in FIG. 17, and the second blanket cleaning device 15 in FIG. 18. The first and second plate dischargers 12 and 17 shown in FIGS. 19 and 20, respectively, are provided for enabling plate ejection and blanket cleaning when the operating lever 60 has returned to the II position as shown in FIG. 21.

Figure 22:
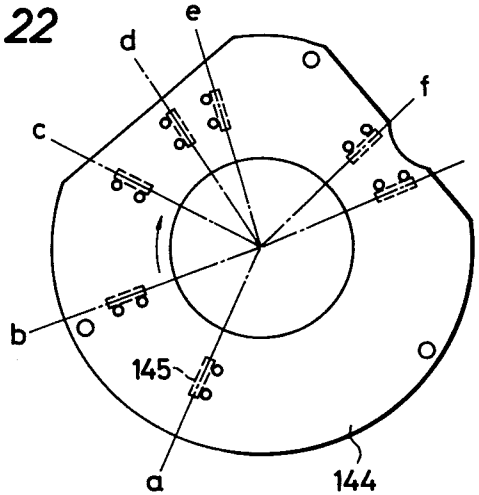
FIG. 22 is a front elevational view of the timing switch plate.

FIG. 22 shows a timing switch plate 144 secured to the first rubber cylinder shaft 25, and carrying a plurality of appropriately spaced switches 145 on its reverse side. A magnet (not shown) is provided on the cylinder advancing cam 78, and faces the switch plate 144. If the cam 78 is rotated clockwise in FIG. 22, the resulting rotary displacement of the magnet causes the switches 145 to be turned on and off to effect a first insertion OFF at point a in FIG. 22, the first insertion ON at point b, the second insertion OFF at point c, the first ejection ON at point d, the second insertion ON at point e, and the second ejection ON at point f.

Figure 23:
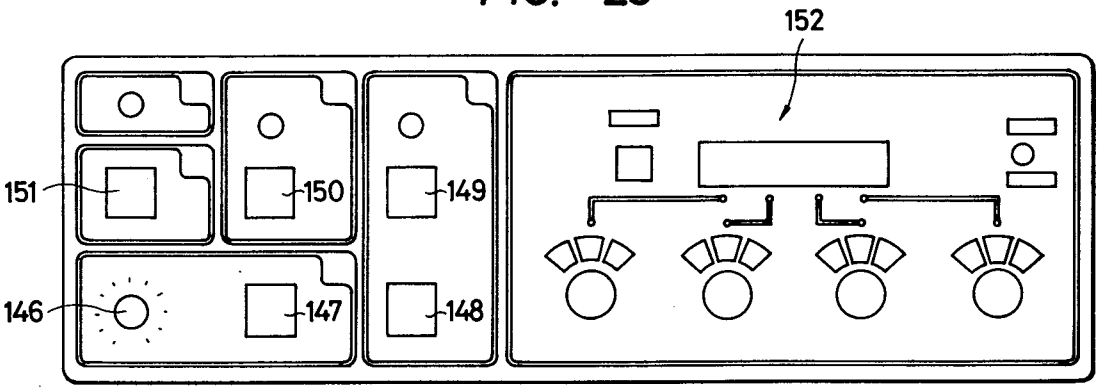
FIG. 23 is a front elevational view of the operation panel.

FIG. 23 shows an operation panel provided with a blanket cleaning timer 146, a blanket cleaning switch 147 for effecting blanket cleaning in the case of formation of an overlapping image even as a result of the first image positional adjustment and a switch 148 for turning the form rollers 121 ON and OFF. The panel is also provided with a second plate ejection switch 149, a first plate ejection switch 150, a switch 151 for interrupting the printing operation, and a sheet counter 152.

The relation between the position of the operating lever 60 and the operation of the various devices will now be described with reference to FIG. 21.

The machine is completely out of operation as long as the operating lever 60 stays in the I position shown in FIG. 2. If the lever is turned to the II position, the drive motor $M_1$ is driven, and the water ductor rollers in the first and second moistening devices 8 and 13 are placed in operation.

The ink ductor rollers in the first and second inking devices 9 and 14 remain out of operation insofar as paper is yet to be supplied. If the lever is turned to the III position, the first form roller is brought into contact with the first plate cylinder 2, the first and second plate feeding devices 11 and 16 are actuated to feed the plates, and the pump motor $M_2$ is driven, whereby paper is made ready for insertion. Although the second form roller is also ready to contact the second plate cylinder 4, the second form roller is adapted for independent operation, depending on whether printing on both sides of the paper or only one side is desired; therefore, the switch is used to bring the second form roller into contact with the second plate cylinder 4 if printing on both sides is desired. The second form roller is kept away from the second plate cylinder 4 if printing on only one side is desired.

If the lever is turned to the IV position, the first and second plate cylinders 2 and 4 are brought into contact with the first and second rubber cylinders 1 and 3, respectively, and the first and second inking devices 9 and 14 are placed in operation, whereby ink is transferred from the form rollers to the plate surfaces. If the lever is turned to the VI position through the V position, the paper feeder 5 is placed in operation to feed paper. If the hand is released from the operating lever 60, the lever 60 returns to the V position immediately to effect printing. If printing is completed, the return mechanism 66 causes the operating lever 60 to return progressively to its initial position. If it returns to the IV position, the operation of the first and second inking devices 9 and 14 is stopped. When the lever is in the III position, the first and second form rollers are separated from the first and second plate cylinders 2 and 4. In the II position, the plates are ejected and the blankets are cleaned, and the operation of the first and second moistening devices is stopped. When the lever has returned to the I position, the operation of the machine is completely stopped.

Figure 24:
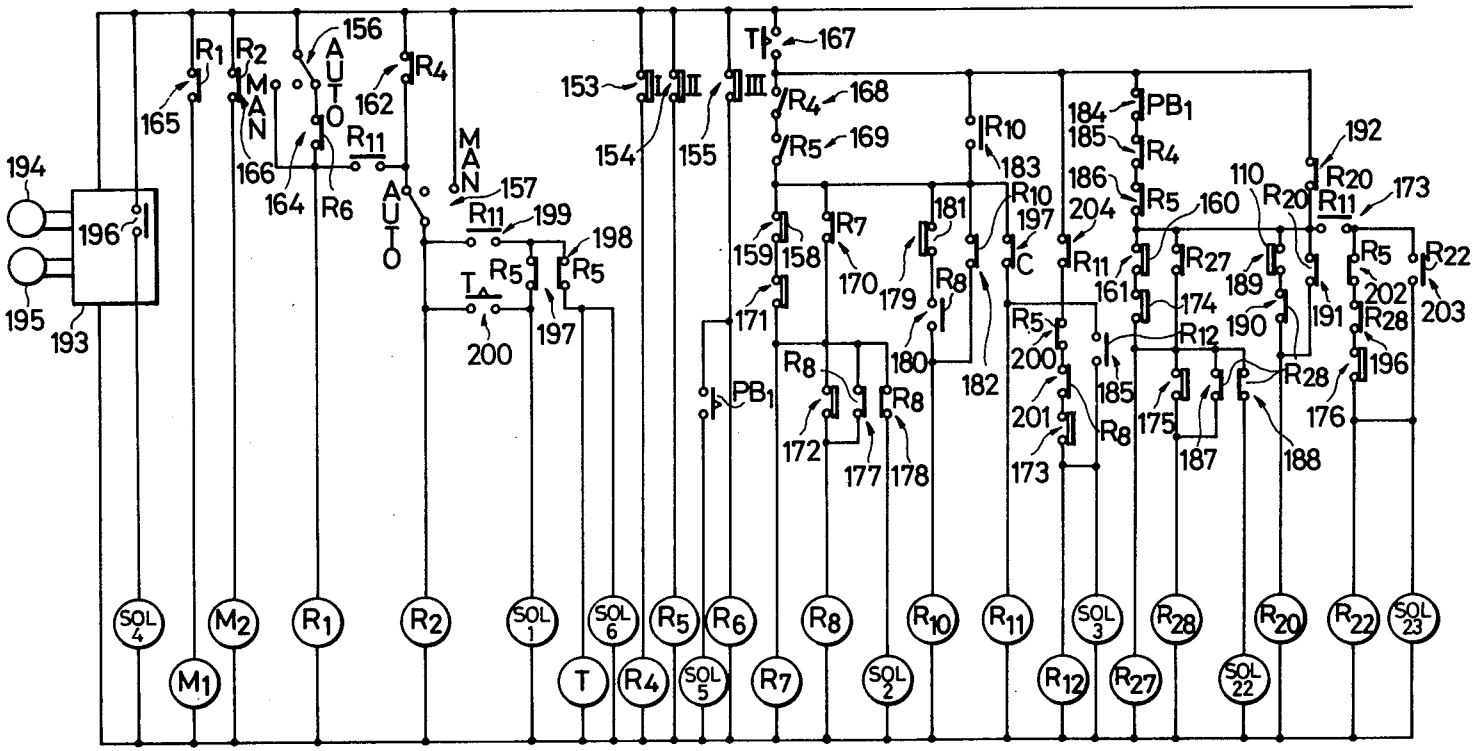
FIG. 24 is an electric circuit diagram.

An electric circuit for the device of the invention is shown in FIG. 24, and will be described with reference thereto.

Switches 153, 154 and 155 are provided for operation upon abutment with a cam secured to the operating shaft 61, but not shown. The cam functions to close the switch 153 except when the operating lever 60 is in the I position, the switch 154 except when the lever 60 is in the II position, and the switch 155 when the lever 60 is in any of the III to VI positions.

A switch 156 is provided for the manual or automatic operation of the pump motor $M_1$. A switch 157 is provided for the manual or automatic operation of the machine motor $M_2$. The following description is directed to the situation in which the switches 156 and 157 are set for automatic operation. A switch PBI is provided for the selection of the second printing (printing on the reverse side). The following description is directed to the situation in which the switch PBI has been turned on for the second printing.

If the first plate is placed on an upper table to start the printing operation, the normally open contact 159 of a switch 158 is closed. Likewise, the normally open contact 161 of a switch 160 is closed if the second plate is placed on a lower table.

If the operating lever 60 is turned to the II position, the contact of the switch 153 is closed to energize the relay $R_6$. Its normally open contact 164 is closed, and an electric current is supplied to a relay $R_1$ through the switch 156 to close its normally open contact 165 to drive the motor $M_1$. As the switch PBI is ON, an electric current is supplied to a solenoid $SOL_5$ to actuate the second form roller, whereby the second form roller is brought into contact with the second rubber cylinder 4. The first form roller is mechanically brought into contact with the first rubber cylinder as hereinbefore stated.

An electric current is supplied to a relay $R_7$ if the contact of a switch 161 is closed through the normally closed contact 167 of a timer T, the normally open contact 168 of the relay $R_4$, the normally open contact 169 of the relay $R_6$ actuated by the switch 155 and the normally open contact 159 of the switch 158. The normally open contact 170 of the relay $R_7$ forms a self-holding circuit which renders the relay $R_7$ operative.

The switches 171 to 173 are provided for timing the mechanism for feeding the plate to the first plate cylinder 2 and ejecting it therefrom. They are actuated once for each rotation of the machine. Likewise, switches 174 to 176 are provided for timing the feeding of the plate to the second plate cylinder 4 and its ejection therefrom.

A solenoid $SOL_2$ is actuated simultaneously with the operation of the relay $R_7$ to cause the plate to be wound about the first plate cylinder.

If the switch 172 is closed, and a relay $R_8$ is energized, the contact 177 of the relay $R_8$ forms a self-holding circuit which renders the relay $R_8$ operative. The solenoid $SOL_2$ is deenergized by the normally closed contact of the relay $R_8$. A normally closed contact 179 is closed when the plate has been wound about the cylinder. If the normally closed contact 179 of the switch 181 is closed when the contact 180 of the relay $R_8$ is closed, a relay $R_{10}$ is energized and its normally open contacts 182 and 183 are closed to form a self-holding circuit. This causes the self-holding of the normally open contact 168 of the relay $R_4$ and the normally open contact 169 of the relay $R_6$. The relays $R_7$ and $R_8$ remain operative even if the operating lever 60 is returned to the I or II position. In other words, the fact that the plate has been wound is memorized.

If the plate has not been wound properly, the switch 158 and the plate remain in contact with each other, and the normally closed contact 179 is not closed. No electric current is supplied to the relay $R_{10}$; therefore, no self-holding circuit is formed. If the operating lever 60 is returned to the I or II position, the relays $R_7$ and $R_8$ are brought to the OFF position, and if the foregoing steps are repeated, the plate can be wound again.

A plate can be wound about the second plate cylinder 4 in the same way as the plate on the first plate cylinder 2, since the contact 184 is in its closed position if the switch PBI is ON.

The foregoing description applies to the mounting of the plate on the second plate cylinder 4, too. For the contact 168, however, read 185, 186 for 169, 161 for 159, 174 for 171, 175 for 172, 187 for 177, 188 for 178, 189 for 179, 190 for 180, 191 for 182, and 192 for 183; for the relay $R_7$, read $R_{27}$, $R_{28}$ for $R_8$ and $R_{20}$ for $R_{10}$; and for the solenoid $SOL_2$, read $SOL_{22}$.

If the operating lever 60 is turned to the VI position to feed paper, a photoelectric device 193 provided on the feeder board is actuated by the paper passing between its light emitter 194 and its light receiver 195. Its contact 196 is closed to energize the cylinder advancing solenoid $SOL_4$ to advance the cylinder.

The number of sheets of papers which have been fed is counted by a counter (not shown).

If a predetermined number of sheets of paper have been printed, a counter contact 197 is actuated to energize a relay $R_{11}$, and its contact 204 forms a self-holding circuit, whereby the relay $R_{11}$ is rendered operative.

If the normally open contact 199 of the relay $R_{11}$ is closed, a return solenoid $SOL_1$ is actuated by the normally open contact 197 of a relay $R_5$ to actuate a ratchet mechanism to cause the operating lever 60 to start to return to its initial position.

If the operating lever 60 returns to the II position, the switches 155 and 154 are disengaged from the cam and the relays $R_5$ and $R_6$ are brought to the OFF position.

If the relay $R_5$ is turned off, its normally open contact 197 is opened, and the return solenoid $SOL_1$ is deenergized to discontinue the operation of the ratchet mechanism.

If the switch 155 is turned off, the solenoid $SOL_5$ for operating the second form roller is deenergized to disengage the form roller from the second plate cylinder 4. This is equivalent to what occurs when the operating lever 60 has returned to the II or I position.

If the relay $R_5$ is turned off, an electric current is supplied to a relay $R_{12}$ to actuate its normally closed contact 200 if the contact of the timing switch 173 is closed through the normally open contact 201 of the relay $R_8$ in its operative position after the plate has been wound on the first plate cylinder 2.

The normally open contact 185 forms a self-holding circuit which maintains the relay $R_{12}$ in its operative position. At the same time, a solenoid $SOL_3$ for plate ejection is energized to effect plate ejection.

The foregoing description applies to the ejection of the plate from the second plate cylinder 4, as well. For the contact 200, however, read 202, 196 for 201, 176 for 173 and 203 for 185; for the relay $R_{12}$, read $R_{22}$; and for the solenoid $SOL_3$, read $SOL_{23}$.

If the relay $R_5$ is turned off, an electric current is supplied to a cleaning solenoid $SOL_6$ through the normally closed contact 204 to effect blanket cleaning. At the same time, an electric current is supplied to a timer T for setting the cleaning time operation.

With the lapse of the time set on the timer T, its normally open contact 200 is closed to energize the return solenoid $SOL_1$, and the ratchet mechanism is actuated to cause the operating lever 60 to return from the II position to the I position. At the same time, the normally closed contact 167 of the timer T is opened. All the relays are turned off, and the operation of the pump motor $M_1$ and the machine motor $M_2$ is stopped. All of the steps of operation are thus completed, and the machine is ready for the next cycle of operation.

The foregoing description has been directed to an operation in which plates which can be automatically wound are used. In the event the plates are wound manually the contact 197 is opened when the counter has counted to a predetermined number. The relay $R_{11}$ is energized to actuate the return solenoid $SOL_1$ through its normally open contact 199, whereby the operating lever 60 returns to its initial position in the same manner as hereinabove described.

As is obvious from the foregoing description, all of the devices in the perfecting press of this invention are easily operated by a single operating lever 60, and as the operating lever 60 returns automatically to its initial position after the printing operation, the plate ejection and blanket cleaning devices can easily be operationally associated with the return of the lever to thereby enable automatic restoration of each step of operation. The paper delivered from the paper feeder is fed smoothly with the rotation of the first rubber cylinder 1 as it is transported by a gripper in a chain delivery device engaged in its opening. The paper is fed smoothly and accurately between the first and second rubber cylinders 1 and 3 to ensure good printing which is free from any printing error, such as displacement. The vertical and horizontal adjustments of the image positions on the first (front) and second (reverse) sides of the paper are easy to achieve using the operating knobs. The press is easily switched over for printing on both sides of the paper or on only one side, since the second printing form roller can be easily moved into contact with the second plate cylinder 3, or away therefrom by switch operation, while the various devices are as easy to operate in printing on both sides as those in any conventional press for printing on only one side. The switchover can be achieved by a simple device.

What is claimed is:

1. A perfecting press, comprising; a first rubber cylinder, a first plate cylinder movable toward and away from said first rubber cylinder, a second rubber cylinder also serving as an impression cylinder, a second plate cylinder movable toward and away from said second rubber cylinder, a paper feeder, a paper discharger, a first moistening device, a first inking device, a first blanket cleaning device, a second moistening device, a second inking device, a second blanket cleaning device, a first plate feeder, a first plate ejection device, a second plate feeder, a second plate ejection device, a first and a second image adjusting device, an operating lever device, and a second printing control device, said first image adjusting device comprising means for rotating said first plate cylinder, including a gear transmission, for enabling vertical adjustment, and for causing said first plate cylinder to slide axially for enabling transverse adjustment, said second image adjustment device comprising means for rotating said second rubber and plate cylinders, including a second gear transmission, for enabling vertical adjustment, and for moving a paper aligning mechanism on a feeder board transversely for enabling transverse adjustment, said operating lever device comprising an operating lever movable to a plurality of positions by a set cam provided on an operating shaft for said lever, said lever being holdable in any of said positions, said devices being operationally associated with said cam and an arm so as to function depending on the angle of rotation of said lever, a solenoid being energized upon completion of the printing operation to cause said lever to return progressively to its initial position in accordance with the rotation of said first rubber cylinder to operate at least said blanket cleaning and plate ejection devices.

2. An apparatus as claimed in claim 1, said second printing control device comprising a form roller movable toward and away from said second plate cylinder independently of a form roller in said first printing control device, to enable switchover between an operation for printing on both sides of said paper and one for printing on only one side thereof.

3. An apparatus as claimed in claim 1, said paper feeder and discharger comprising a chain delivery mechanism having a gripper engageable in an opening in said first rubber cylinder upon rotation of said chain delivery mechanism, and a mechanism provided in said opening to actuate said gripper for gripping paper to transport the same.

4. An apparatus as claimed in claim 1, said first and second plate cylinders, and said second rubber cylinder each being supported on eccentric shafts for relative movement therebetween.

5. An apparatus as claimed in claim 1, said first image adjusting device comprising an operating knob, the rotation of which is transmitted to said first plate cylinder through said gear transmission, for vertical adjustment thereof.

6. An apparatus as claimed in claim 5, further comprising a further knob for transverse adjustment, and means for translating rotation of said further knob into an axial movement of a shaft of said first plate cylinder.

7. An apparatus as claimed in claim 1, said second adjusting device comprising an operating knob, the rotation of which is transmitted via said second gear transmission to said second rubber cylinder and said second plate cylinder, for effecting vertical adjustment thereof.

8. An apparatus as claimed in claim 7, further comprising a further knob for transverse adjustment, and means for translating rotation of said knob into a transverse displacement of said paper aligning mechanism.

9. An apparatus as claimed in claim 1, said operating lever device further including an automatic return mechanism actuatable in response to energization of said solenoid, and including a ratchet and pawl mechanism engageable subsequent to said energization, said ratchet being rotated in response to rotation of said first rubber cylinder.

10. An apparatus as claimed in claim 1, further including a cylinder advancing cam associated with said first rubber cylinder, and means operatively connecting said cam with eccentric shafts of said first plate cylinder, said second rubber cylinder and said second plate cylinder.

11. An apparatus as claimed in claim 2, said operating lever having a first position comprising an inoperative neutral position, a second position for controlling said moistening devices, a third position for controlling said plate feeding devices and for bringing at least said first printing control device form roller into contact with said first plate cylinder, a fourth position for controlling said first and second plate cylinders to contact said first and second rubber cylinders, respectively, and for actuating said inking devices, a fifth position for controlling a printing operation and a manually achievable momentary sixth position for actuating said paper feeder.

* * * * *